United States Patent [19]

Brickman

[11] Patent Number: 4,625,656

[45] **Date of Patent: * Dec. 2, 1986**

[54] FOLDABLE TABLE WITH STORAGE CAPABILITY

[76] Inventor: Harold Brickman, 2911 W. Catalpa, Chicago, Ill. 60625

[ * ] Notice: The portion of the term of this patent subsequent to Aug. 5, 2003 has been disclaimed.

[21] Appl. No.: 703,105

[22] Filed: Feb. 19, 1985

[51] Int. Cl.[4] ..... A47B 85/00

[52] U.S. Cl. ..... 108/25

[58] Field of Search ..... 108/25; 24/545

[56] References Cited

U.S. PATENT DOCUMENTS

| | | | |
|---|---|---|---|
| 739,668 | 9/1903 | Gooding | 24/545 |
| 2,241,309 | 5/1941 | Kovalik | 108/25 X |
| 2,464,015 | 3/1949 | Young | 24/545 |
| 4,122,780 | 10/1978 | Brickman | 108/25 |
| 4,177,737 | 12/1979 | Brickman | 108/25 X |
| 4,226,006 | 10/1980 | Toyama | 24/545 X |

*Primary Examiner*—William E. Lyddane
*Assistant Examiner*—José V. Chen
*Attorney, Agent, or Firm*—McDougall, Hersh & Scott

[57] ABSTRACT

A folding table has a flexible table top provided with openings. Attached to the table top and extending below it is a rigid panel with receptacles aligned with the openings. The receptacles are designed to accommodate beverage consumption articles such as bottles, an ice bucket, and the like, for the purpose of use when the table is open, and for the purposes of transportation or storage when the table is closed. The table top is formed as a one piece construction and is attached by fasteners to the rigid panel.

2 Claims, 8 Drawing Figures

FOLDABLE TABLE WITH STORAGE CAPABILITY

BACKGROUND OF THE INVENTION

This invention relates generally to folding tables. More specifically, it relates to improvements in such tables having a rigid panel extending beneath the table top, the panel provided with receptacles for the use and storage of beverage containers and accessories.

In copending application Ser. No. 579,489 filed Feb. 13, 1984 by Leonid Soren for a "Folding Table", a foldable bar table is disclosed having a rigid receptacle panel for holding various bar items. Referenced in that application are U.S. Pat. Nos. 4,122,780, 4,177,738 and Design No. 252,659.

In folding tables known to the applicant, the manufacture of such tables may be relatively costly. This is in part because of the steps needed to attach the rigid receptacle panel to the flexible table top. The flexible table top must be cut from two pieces of material, and the pieces joined at their inner ends to form a center-seam. Two complementary rigid panels are bonded together to form the receptacle panel while the top portion of these panels constitutes a means that secures the center-seam of the table top. As a result of these manufacturing steps, the cost of producing these tables is relatively high.

Hence, it is an object of this invention to provide a table of such design that the receptacle panel can be attached to the table top without the need of the aforementioned manufacturing steps.

Another disadvantage to the current tables is that the table top and receptacle panels may be prone to separate because of stress from such acts as repeated opening of the table top and the downward force of the receptacle panel, especially when the table is being used in its closed configuration to transport bottles, ice buckets, and other items located in the receptacles.

Therefore, it is a further object of this invention to provide a table of such design that the bond between the receptacle panels and the table top will not weaken, causing the two pieces to separate.

Still another disadvantage of the current tables is that they cannot be easily disassembled and reassembled. This is in part because the steps needed to remove and refasten the receptacle panel can only be done in an appropriately equipped factory or repair shop. This makes user repair or cleaning of such tables difficult.

Thus, it is a further object of this invention to provide a table of such design that the user may remove and reinstall the receptacle panel or the table top.

BRIEF DESCRIPTION OF THE INVENTION

The foregoing and other objects of the invention are achieved by providing a flexible table top formed as a unitary structure with separate means for attaching table top to the rigid panel.

BRIEF DESCRIPTION OF THE DRAWINGS

The invention itself is described in the detailed description taken in conjunction with the drawings in which.

DETAILED DESCRIPTION

Figure 1:
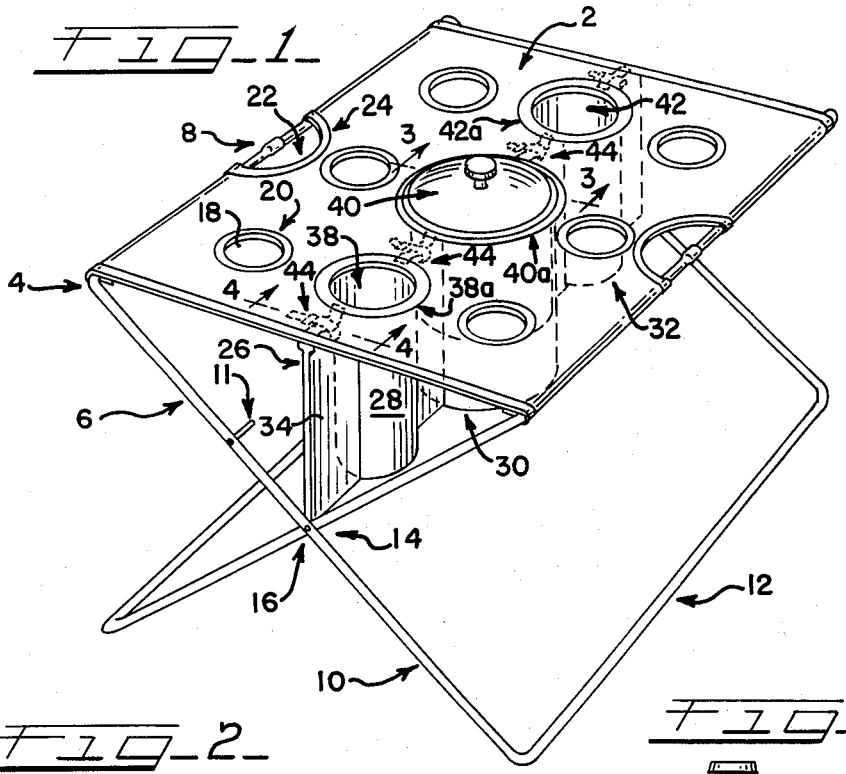
FIG. 1 is a perspective illustration of the invention showing the table in an open or in use position.

Referring first to FIG. 1, the folding table comprises table top 2 formed from flexible material such as canvas or a plastic, in a generally rectangular shape. The table top is provided with a pair of loops 4 at opposite ends which may be formed by heat sealing, stitching, or the use of adhesives. Passing through the loops are top horizontal portions 8 of a pair of rectangular frames 6. Each frame comprises the top horizontal portion 8, a pair of sides 10 that extend diagonally downward and function as legs to support the table, a horizontal bottom portion 12, and is formed of rigid light weight material such as a tubular metal. The sides 10 are pivotally joined together at 14 by connecting rod or pivot point 16 that extends horizontally between the two pivot points. A horizontally extending top pin 11 may be provided on one of the sides 10 to limit the movement of the sides as the table is collapsed so the sides will not swing past each other. In the alternative, the horizontal bottom portions 12 could be omitted so that the frame comprising the supporting legs and top horizontal portion could be three-sided, or U-shaped.

The surface of the table top 2 is provided with a plurality of openings 18 which are dimensioned to receive glasses or drinking containers. It is contemplated that the glasses or containers inserted would have sloping sides so that they will not pass entirely through the openings, but rather would have their upper portions extending above the surface of the table, whereby they may be lifted out of the openings and used. The openings 18 may be reinforced by stiffening rings 20 formed of plastic or other suitable material.

A pair of cutaway portions 22 are provided on opposite sides of the table top 22 exposing the center portion of the horizontal top portions 10, thereby providing a handle for easy grasping of the table when folded. The edges of cutaway portions 22 may be reinforced by stiffening members 24.

Figure 3:
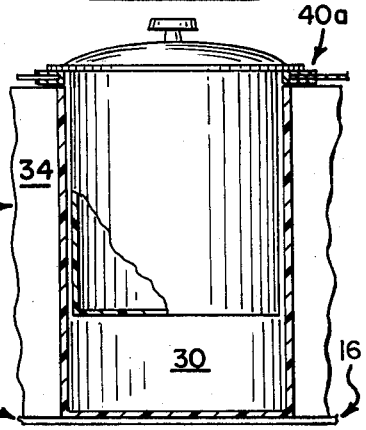
FIG. 3 is a sectional view of the table in FIG. 1, taken along line 3—3, illustrating an ice bucket housed in a receptacle in accordance with the invention.

As illustrated in FIGS. 1 and 3, located below the center of the table top 2, and extending longitudinally is receptacle panel 26 comprising a plurality of receptacles 28, 30, 32 extending upward from center panel 34 formed out of any suitable rigid material such as plastic, metal or wood. The receptacles 28, 32 may be dimensioned to house beverage consumption containers, such as bottles, so the top portion of such containers extend above the receptacles, easily accessible for use. The receptacle 30 may be dimensioned to receive an ice bucket insulated by foam or air. The bottom of the center panel 34 has a longitudinal cavity 36 so that the connecting rod 18 may pass through it.

Located in the center of the table top 2 are a plurality of larger openings 38, 40, 42 aligned and having the same shape as the openings for receptacles 28, 30, 32. These openings, reinforced by stiffening rings 38*a*, 40*a*, 42*a*, allow the bottles, ice bucket, and other materials to be put in and taken out of the receptacles when the table is open and in use. The stiffening rings 38*a*, 40*a*, 42*a*, may be formed as part of the receptacle panel 26 comprising upper and lower flange members around the openings of the receptacles 28, 30, 32.

Figure 8:
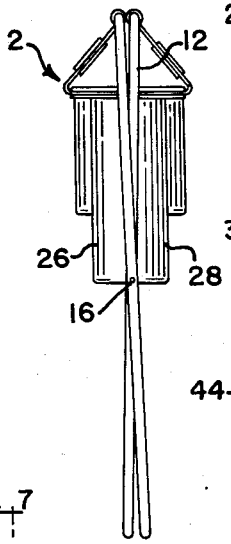
FIG. 8 is a side view of the table in a closed or in storage position.

FIG. 8 illustrates the table in its closed position when the sides 12 are pivoted around pivot points 16 bringing the outer edges of the table top 2 together at a point spaced above the upper surface of the table top, so the upper portions of the table top "blouse" outwardly. This construction permits the table to be collapsed and occupy a relatively small amount of floor space for ease of both transportation and storage purposes. The "blousing out" of the upper portions of the table top provides space therebetween to accommodate the upper portions of items housed in the receptacles 28, 30, 32. When the table is opened the items stored in the receptacles will be ready for immediate use.

Figure 2:
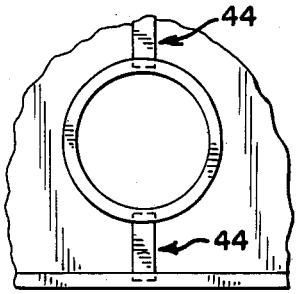
FIG. 2 is a top view of the table top illustrating how securing means in accordance with the invention may be located.
Figure 4:
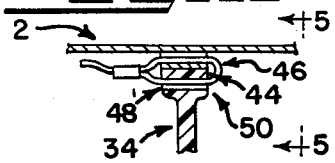
FIG. 4 is a sectional view of the table in FIG. 1, taken along line 4—4 of a fastener in acordance with the embodiment of FIG. 1 used to secure the receptacle panel to the table top.
Figure 5:
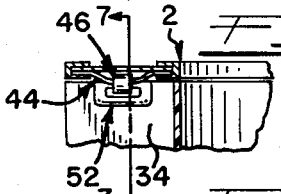
FIG. 5 is a side view of the fastener in FIG. 4 taken along line 5—5.

FIGS. 2, 4, and 5 illustrate how the receptacle panel 26 is attached to the table top 2. Across the underside of the table top 2 are a plurality of straps 44 arranged longitudinally, aligned with rigid panel 34, and affixed at each of their ends to the table top by stitching or by the use of adhesives. Passing through each of the straps 44 is a holding means such as a tie fastener 46 which also passes through mounting opening or hole 48 located in the top of center panel 34 and aligned with the strap. The tie fastener may be a conventional cable tie or any other device capable of being looped through the strap 44 and a mounting hole 48 to provide secure attachment. The mounting holes 48 may be located in a top horizontal flange 50 centered and located at the top of the rigid panel 34, and having a width approximately equal to the width of the straps 44. The tie fastener 46 is passed through the loop formed by the strap 44 and mounting hole 48 pulled tight or otherwise secured holding the receptacle panel 26 to the table top 2.

With this construction the user may separate the receptacle panel 26 from the table top 2 by cutting the tie fasteners 46 in order to replace the table top if desired. The pieces can then be reattached by the use of new tie fasteners.

Figure 6:
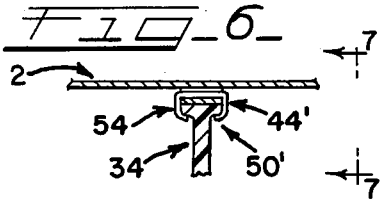
FIG. 6 is a sectional view of a second embodiment of fastener used to secure the receptacle panel to the table top.
Figure 7:
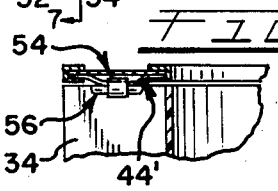
FIG. 7 is a side view of the fastener in FIG. 5 taken along line 7—7.

FIGS. 6 and 7 illustrate an alternative embodiment for attaching the receptacle panel 26 to the table top 2. In this embodiment a spring clip 54 is passed through a strap 44' so that its middle portion is adjacent the underside of the table top, and its end portions extend downward. The receptacle panel 26 is formed with a flange 48' of substantially the same width as the spring clip and is then inserted into the spring clip so the side and end portions of the spring clip grasp the side and underside portions of the flange, securing the receptacle panel.

This embodiment makes it possible to attach the receptacle panel to the table top without need for mounting holes in the receptacle panel. In addition, the user can separate the two pieces by deforming the spring clip with a hand tool, (e.g. needle nose pliers). When the user wishes to reattach the pieces all that is necessary is to bend the spring clip back into shape. Should the receptacle panel and table top separate due to the flange, spring clip or strap breaking, the user would also be able to repair the table using tools and material commonly available.

While I have shown and described embodiments of this invention in some detail it will be understood that this description and illustrations are offered merely by way of example, and that the invention is to be limited in scope only by the appended claims.

What is claimed as new and desired to be secured by Letters Patent is:

1. In a foldable table comprising a flexible table top having a plurality of openings therein to accommodate articles for beverage consumption or storage, a pair of legs having portions engaging opposite ends of said table panel and pivoted at an intermediate location along their legs whereby they may be spread apart to open the table for use or brought together to permit storage and transporting the table for use, and a rigid receptacle panel having a plurality of receptacles below said table top, said receptacles aligned below said openings in said table top to house articles placed therein, said rigid panel having a horizontal flange along its top and having a plurality of openings provided in said horizontal flange, a plurality of straps secured to the underside of said table top, looped fasteners passing through said straps and said openings attaching said rigid panel to the underside of said table top.

2. In a foldable table comprising a flexible table top having a plurality of openings therein to accommodate articles for beverage consumption or storage, a pair of legs having portions engaging opposite ends of said table panel and pivoted at an intermediate location along their legs whereby they may be spread apart to open the table for use or brought together to permit storage and transporting the table for use, and a rigid receptacle panel having a plurality of receptacles below said table top, said receptacles aligned below said openings in said table top to house articles placed therein, fastening means comprising a plurality of straps secured to the underside of said table top, a horizontal flange located and centered on the top of said rigid panel, spring clips passing through said straps and engaging the sides of said flange.

* * * * *